United States Patent [19]

Larson

[11] 3,940,003

[45] Feb. 24, 1976

[54] SAFETY CAP FOR MEDICAMENT VIAL HAVING PUNCTURABLE SEAL

[75] Inventor: Roger R. Larson, Champaign, Ill.

[73] Assignee: Pharmaco, Inc., Champaign, Ill.

[22] Filed: May 7, 1974

[21] Appl. No.: 467,802

[52] U.S. Cl. ..... 215/247; 128/272; 206/363

[51] Int. Cl.². B65D 41/20; B65D 51/22; A61J 1/08

[58] Field of Search ..... 206/363, 365; 215/247, 215/257, DIG. 3; 128/272

[56] References Cited

UNITED STATES PATENTS

| | | | |
|---|---|---|---|
| 3,336,924 | 8/1967 | Sarnoff et al. | 206/365 X |
| 3,505,775 | 4/1970 | Andersen et al. | 206/439 X |
| 3,823,840 | 7/1974 | Zackheim | 215/247 |

FOREIGN PATENTS OR APPLICATIONS

| | | | |
|---|---|---|---|
| 892,210 | 3/1962 | United Kingdom | 215/247 |

*Primary Examiner*—Leonard Summer
*Attorney, Agent, or Firm*—Clarence A. O'Brien; Harvey B. Jacobson

[57] ABSTRACT

The safety cap of the present invention is for use with a medicament vial having a puncturable seal. The cap includes a cylindrical extension provided with a shape-retentive but slightly expandable cylindrical body slidable therein having a diametrically reduced sharpened tubular needle extension on its inner end for piercing the seal. The body includes first and second portions of slightly different diameters, with the portion of smaller diameter outermost, and an inwardly tapering center portion, thus defining two shoulders for cooperating with an inwardly projecting lip on the outer end of the cylindrical extension to resiliently resist inward movement of the body and to prevent outward withdrawal of the body after it has been pressed inwardly to puncture the seal.

The body has a central bore formed therethrough defining an inwardly tapering passage and a larger diameter counterbore in which the pointed end of a hypodermic needle and the tapered tip extension of a conventional syringe barrel may be wedgingly and sealingly seated.

6 Claims, 7 Drawing Figures

Fig. 1
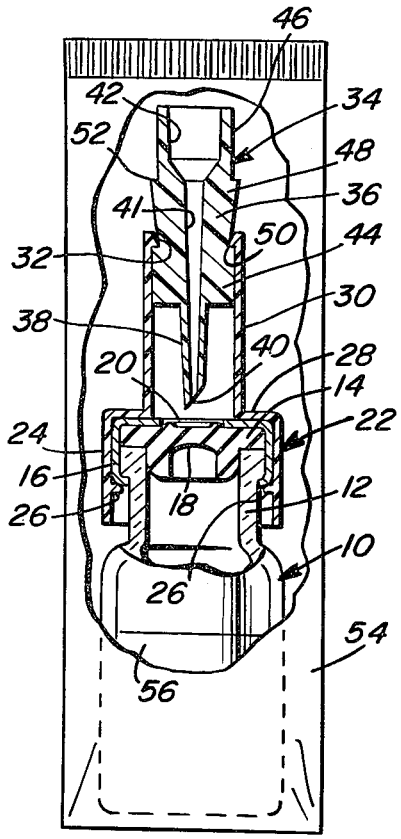
Fig. 2
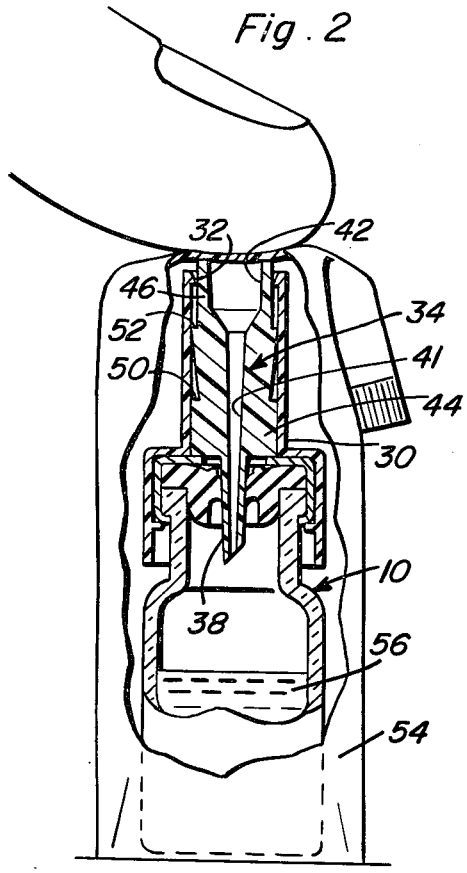
Fig. 6
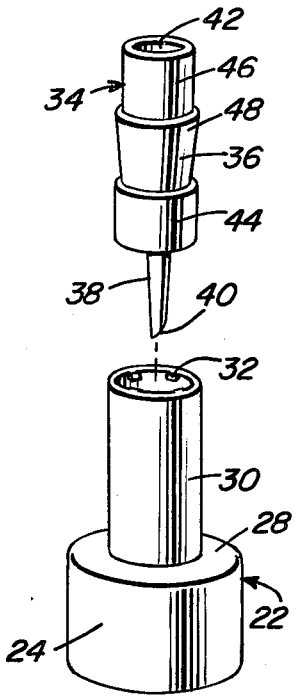
Fig. 5
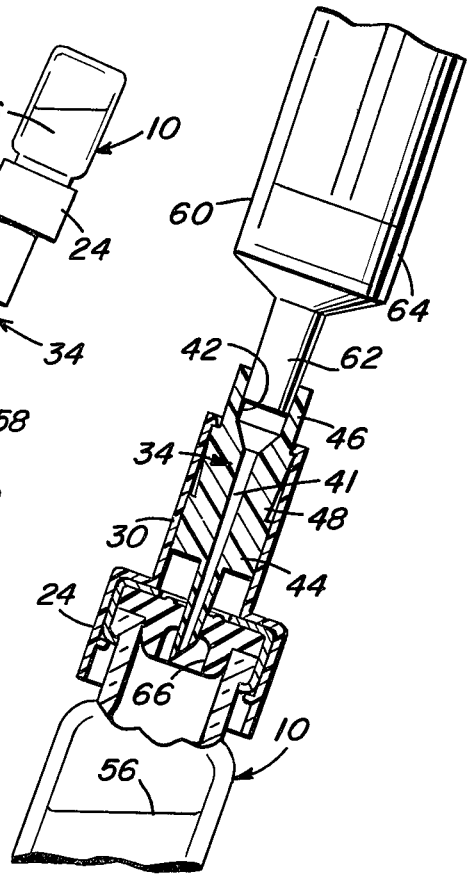
Fig. 7
Fig. 3
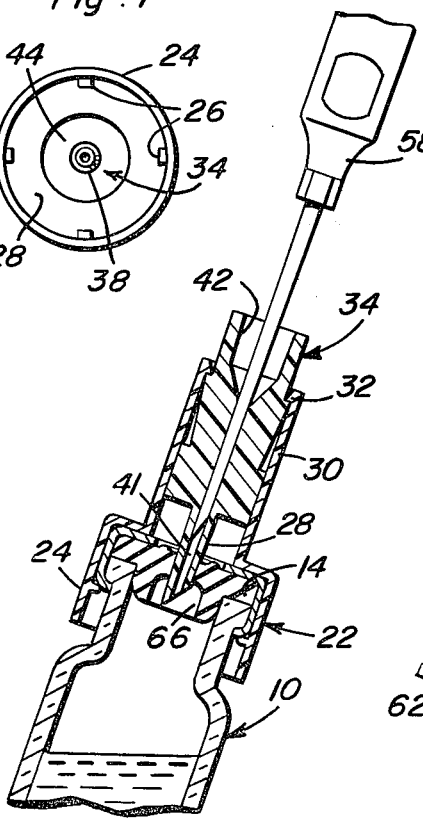
Fig. 4
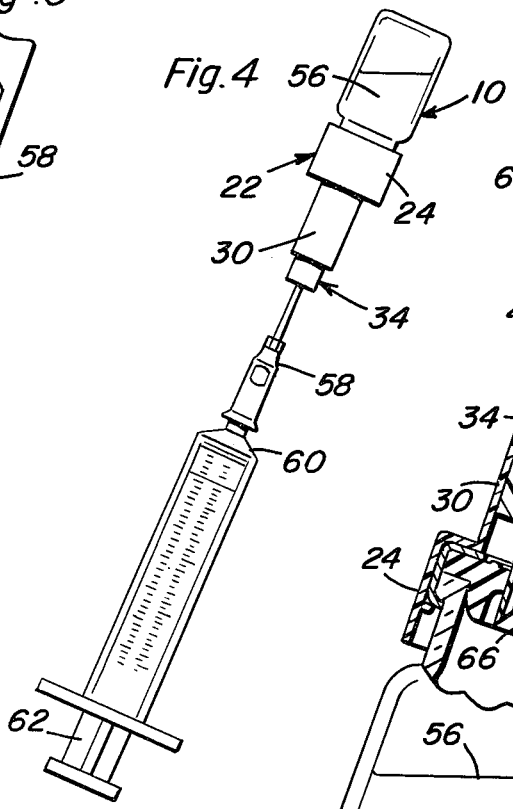

SAFETY CAP FOR MEDICAMENT VIAL HAVING PUNCTURABLE SEAL

BACKGROUND OF THE INVENTION

The instant invention comprises a modification of the medicament vial stopper piercing and needle positioning device disclosed in my copending U.S. application Ser. No. 385,798, filed Aug. 6, 1973, now U.S. Pat. No. 3,872,992, issued Mar. 25, 1975, and constitutes an improvement thereover in that the safety cap of the instant invention may be utilized in conjunction with a hypodermic syringe equipped with a needle for withdrawing medicament from a vial or a syringe which is not equipped with a hypodermic needle point but which will still serve the purpose of piercing the puncturable seal on the medicament vial and allow the medicament to be withdrawn from the vial and into the barrel of the syringe.

The safety cap of the instant invention relates to an apparatus which not only provides a protective cover over the pucturable seal carried by the mouth of a medicament vial but which will also be capable of piercing the seal and enabling a hypodermic needle point to be seatingly engaged with a tubular portion of the seal piercing portion of the cap in a manner to enable fluid within the medicament vial to be withdrawn therefrom in a manner which positively prevents coring of the seal by the hypodermic needle.

The safety cap comprises an apparatus constructed of plastic so as to be shape-retentive and yet slightly deformable to enable either the tip of a hypodermic needle or the tapered tubular tip extension of a conventional syringe barrel to be wedgingly seated therein.

BRIEF DESCRIPTION OF THE INVENTION

The safety cap of the instant invention is provided as a safety cover for the puncturable seal across the mouth of a medicament vial and includes a tapered needle portion which may be advanced through the pucturable seal of an associated vial and includes portions thereof that are adapted to wedgingly and sealingly seatingly receive either the tip of a hypodermic needle or the tapering tubular tip extension of a conventional syringe barrel for the purpose of enabling liquid medicament from within the vial to be withdrawn into the associated syringe barrel whether equipped with a hypodermic needle on its tubular tip extension or being without a hypodermic needle. The cap is of a configuration to be marketed on the associated medicament vial with the cap and the medicament vial enclosed within a sterile overwrap and the seal piercing portion of the cap being exposed and movable toward a seal piercing position in such a manner so as to be readily moved from an inoperative position to a seal piercing position without rupturing or otherwise opening the sterile overwrap.

The primary object of this invention is to provide a coupling structure carried by the sealed end of a medicament vial and by which medicament may be withdrawn from the vial in a sterile manner either through the utilization of a syringe equipped with a needle or a syringe not provided with a needle but equipped with the usual tapering tubular tip extension on the barrel portion thereof provided to support a hypodermic needle.

Another object of this invention is to provide an apparatus which may be utilized in conjunction with different types of medicament vials but which is designed primarily for use in conjunction with unit dose medicament vials.

A final object of this invention to be specifically enumerated herein is to provide a device in accordance with the preceding objects which will conform to conventional forms of manufacture, be of simple construction and easy to use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE DRAWINGS

FIG. 1 is an elevational view of a unit dose vial of medicament closed by means of the usual rubber seal or plug supported in position by means of an aluminum ring and with the cap of the instant invention operatively secured over the plug and ring and the entire vial and cap structure enclosed within a protective sterile overwrap and the plug piercing portion of the needle structure of the cap in the retracted position, portions of the vial, closure plug, aluminum retaining ring and cap of the instant invention being broken away and illustrated in vertical section;

FIG. 2 is an elevational view similar to FIG. 1 but with the needle structure portion of the cap in an inwardly displaced stopper or seal piercing position;

FIG. 3 is a fragmentary sectional view of the structure illustrated in FIG. 2 with the plug or seal piercing needle portion of the cap in a slightly retracted position under the biasing action of the resilient cap or seal and with the pointed tip of a hypodermic needle wedged into the tapering passage formed through the plug or seal piercing portion of the cap;

FIG. 4 is an elevational view illustrating the manner in which medicament may be withdrawn from the vial into a syringe after the plug or seal of the vial has been pierced and the needle of the syringe has been positioned in the manner illustrated in FIG. 3;

FIG. 5 is an elevational view illustrating the manner in which the tapering tubular tip extension of a conventional syringe barrel may be wedgingly and sealingly seatingly received in the tapering outer counterbore of the seal piercing needle structure of the cap;

FIG. 6 is an exploded perspective view of the two components which comprise the cap; and FIG. 7 comprises a bottom end view of the cap.

DETAILED DESCRIPTION OF THE INVENTION

Referring now more specifically to the drawings the numeral 10 generally designates a unit dose vial including a neck portion 12 closed at its outer end by means of a conventional rubber stopper 14 held in position by means of a metal retaining ring 16 which is usually constructed of aluminum. The stopper 14 includes a central portion 18 which is adapted to be pierced by a hypodermic needle advanced through a center opening 20 in the ring 16, which center opening is usually closed by means of an integral but removable portion of the ring 16. However, for use in conjunction with the instant invention to be described hereinafter the opening 20 is left unobstructed.

The safety cap of the instant invention is referred to in general by the reference numeral 22 and includes a cap portion 24 equipped with circumferentially spaced and inwardly projecting lugs 26 for snap engagement over the retaining ring 16. The cap portion 24 includes an upper end wall 28 including an upwardly projecting tubular mounting portion 30 whose lower end opens downwardly through the end wall 28. The upper terminal end of the extension 30 includes circumferentially spaced inwardly projecting abutments 32 and a needle structure referred to in general by the reference numeral 34 is provided. The needle structure 34 includes a generally cylindrical body 36 provided with a small diameter downwardly tapering lower end extension 38 which is sharpened at its lower end as at 40. The extension 28 defines a stopper piercing needle for piercing the central portion 18 of the stopper 14. The body 36 includes a tapering bore 41 extending therethrough and including a tapering continuation extending through the extension 38. The end of the bore 41 remote from the extension 38 includes a slightly tapering diametrically enlarged counterbore 42, the counterbore 42 tapering inwardly toward the bore 41.

The cap portion 24 and the tubular mounting portion 30 as well as the needle structure 34 are constructed of plastic material which has shape-retentive properties but which is slightly deformable. The upper body portion 36 of the needle structure 34 includes a large diameter lower end portion 44 which is slidably received within the tubular mounting portion 30 below the inwardly projecting abutments 32 and a smaller diameter cylindrical upper end portion 46 which is freely slidable in the upper end of the tubular mounting portion 30 inwardly of the inner extremities of the abutments 32. The body 36 also includes a tapering central portion 48 whose minor diameter end terminates at a radially outwardly projecting shoulder 50 extending circumferentially about the outermost portion of the inner end portion 44 of the body 36 and the inner end of the outer end portion 46 terminates inwardly at a radially outwardly projecting and circumferentially extending shoulder 52 defined by the outer end of the central tapering portion 48 of the body 36.

In operation, the entire assembly including all of the components heretofore described is enclosed within a sealed sterile outer wrap 54 of flexible material. The needle structure 34 is initially positioned as illustrated in FIG. 1 of the drawings with the inwardly projecting abutments 32 seated about the inner extremity of the inwardly tapering central portion 48 of the body 36 and the sharpened innermost tip of the needle defining extension 38 spaced outwardly of the central portion 18 of the stopper 14.

When it is desired to withdraw the liquid medicament 56 from within the vial 10 pressure is applied to the outer end of the needle structure 34 through the protective outer wrap 54 in the manner illustrated in FIG. 2 of the drawings so as to inwardly displace the needle structure 34 relative to the tubular mounting portion 30 to the position thereof illustrated in FIG. 2 of the drawings with the needle defining extension 38 of the body 36 projecting through the central portion 18 of the stopper 14. Initial movement of the needle structure inwardly from the first position thereof illustrated in FIG. 1 toward the second position thereof illustrated in FIG. 2 is resisted by the tapering outer surfaces of the central portion 48 of the body 36 which cause the outer end of the tubular mounting portion 30 to expand. Accordingly, inward movement of the needle structure 34 is met with increasing resistance to the inward pressure being applied to the needle structure 34. However, when the major diameter end portion of the central tapering portion 48 of the body 36 moves toward a third intermediate position (not shown) just inwardly of the inwardly projecting abutments 32 and the pointed tip of the extension 38 has partially penetrated and downwardly deflected the central portion 18 of the stopper 14, further downward displacement of the needle structure 34 is not resisted by the inwardly projecting abutments 32 and final movement of the needle structure 34 to the second position thereof illustrated in FIG. 2 with the lower or inner end of the inner end portion 44 of the needle structure 34 abutted against the stopper retaining ring 16 is accomplished by a snap action so as to insure that the needle defining extension 38 will fully pierce the central portion 18 of the stopper 14. Then, as the pierced and downwardly deflected central portion 18 of the stopper 14 returns to its static position upon the release of downward manual pressure on the needle structure 34, the engagement of the shoulder 52 with the inwardly projecting abutments 32 positively prevents further outward movement of the needle structure 34 relative to the tubular mounting portion 30 of the cap 22.

After the needle structure 34 has been inwardly displaced to pierce the stopper 14, the protective outer wrap 54 is removed and a hypodermic needle 58 supported from a syringe 60 may be wedgingly and sealingly seated in the tapering bore 41 and the syringe 60 and vial 10 may be inverted as illustrated in FIG. 4 of the drawings with the vial 10 supported solely from the needle 58 and the piston portion 62 of the syringe 60 pulled downwardly to extract the medicament 56 from within the vial 10. On the other hand, if it is desired to withdraw the medicament 56 from the vial 10 by means of a syringe 60 which is not equipped with a hypodermic needle 58, the slightly tapering tubular tip extension 62 of the syringe barrel 64 may be wedgingly and sealingly seated in the counterbore 42 in the manner illustrated in FIG. 5 of the drawings, after which the syringe 60 and vial 10 may be inverted as before in order to withdraw the medicament 56 from within the vial 10.

The taper of the bore 41 and the taper of the counterbore 42 in conjunction with the shape retentive but slightly deformable plastic material of which the needle structure 34 is constructed enables either the needle 58 to be wedgingly seated in the bore 41 or the top extension 62 to be wedgingly seated in the counterbore 42 in such a manner that the necessary pressure to withdraw the needle 58 from the bore 41 or the tubular tip extenson 62 from the counterbore 42 will be greater than that which may be required to slightly retract the extension 38 through the centrally pierced stopper 14 into the inwardly opening cavity 66 formed in the inner end of the stopper 14 with the shoulder 52 abutted against the abutments 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. For use in connection with a container having a puncturable seal, a closure cap for support from said container in position with a mounting portion of said cap disposed outwardly of said seal, a tubular needle structure having one pointed end supported from said mounting portion for movement toward and away from the outer side of said seal between a first position with said one pointed end retracted away from said seal and a second position with said one pointed end projected through the seal, said mounting portion of said cap and said needle structure including coacting means progressively and increasingly yieldingly resisting movement of said needle structure from said first position to a third position intermediate said first and second positions with said pointed end at least initially engaged with said seal and then releasing said needle structure for free movement from said third position to said second position.

2. The combination of claim 1 wherein said coacting means also includes means for positively preventing retractive movement of said needle structure from said second position toward said first position past said third position.

3. The combination of claim 2 wherein said mounting portion comprises a tubular support member in which said tubular needle structure is slidingly received, said coacting means including inwardly projecting lip means on the end of said tubular support member opposite to the pointed end of said needle structure and a shoulder on said needle structure opposing and engageable with said lip means, said shoulder on said needle structure being defined on the major diameter end of a frusto-conical outer surface portion of said needle structure tapering toward said one pointed end, said tubular support member being constructed of shape retentive but slightly expandable material whereby said lip means may be expanded over the major diameter end of said frusto-conical outer surface portion.

4. The combination of claim 3 wherein the outer end of said interior bore portion includes a slightly inwardly tapering larger diameter bore adapted to wedgingly and sealingly seatingly receive the slightly tapering tubular tip extension of a conventional syringe barrel therein.

5. For use in connection with a container having a puncturable seal, a closure cap for support from said container in position with a mounting portion of said cap disposed outwardly of said seal, a tubular needle structure having one pointed end supported from said mounting portion for movement toward and away from the outer side of said seal between a first position with said one pointed end retracted away from said seal and a second position with said one pointed end projected through the seal, said mounting portion comprising a tubular support member in which said tubular needle structure is slidingly received, said mounting portion of said cap and said needle structure including coacting means positively preventing retractive movement of said needle structure from said second position toward said first position past a third position intermediate said first and second positions, said coacting means including inwardly projecting lip means on the end of said tubular support member opposite to the pointed end of said needle structure and a shoulder on said needle structure opposing and engageable with said lip means, said shoulder on said needle structure being defined on the major diameter end of a frusto-conical outer surface portion of said needle structure tapering toward said one pointed end, said tubular support member being constructed of shape retentive but slightly expandable material whereby said lip means may be expanded over the major diameter end of said frusto-conical outer surface portion.

6. The combination of claim 5 wherein said tubular needle includes an interior thin walled bore portion tapering toward said one end of said needle structure and of a diameter adapted to wedgingly and sealingly seatingly receive the pointed end of a hypodermic needle therein with the needle releasably retentively retained in said tapering bore portion against withdrawal therefrom by a force below a predetermined value.

* * * * *